US009121198B2

(12) United States Patent
Gresser

(10) Patent No.: US 9,121,198 B2
(45) Date of Patent: Sep. 1, 2015

(54) DOOR OPENER FOR CLOSED-CIRCUIT CURRENT OPERATION AND OPEN-CIRCUIT CURRENT OPERATION

(75) Inventor: Dieter Gresser, Meβstetten (DE)

(73) Assignee: ASSA ABLOY Sicherheitstechnik GmbH (DE)

( * ) Notice: Subject to any disclaimer, the term of this patent is extended or adjusted under 35 U.S.C. 154(b) by 777 days.

(21) Appl. No.: 13/358,608

(22) Filed: Jan. 26, 2012

(65) Prior Publication Data

US 2012/0193927 A1 Aug. 2, 2012

(30) Foreign Application Priority Data

Jan. 28, 2011 (DE) ..... 10 2011 009 782

(51) Int. Cl.
*E05C 3/04* (2006.01)
*E05B 47/00* (2006.01)

(52) U.S. Cl.
CPC ..... *E05B 47/0047* (2013.01); *E05B 2047/0073* (2013.01); *E05B 2047/0076* (2013.01); *Y10T 292/1082* (2015.04)

(58) Field of Classification Search
USPC ..... 292/201, 251.5
See application file for complete search history.

(56) References Cited

U.S. PATENT DOCUMENTS 3,819,215 A * 6/1974 Fuss ..... 292/201
4,211,443 A * 7/1980 Butts et al. ..... 292/341.16
5,490,699 A * 2/1996 Uyeda ..... 292/341.16
5,788,295 A 8/1998 Fuss et al.
5,924,750 A * 7/1999 Fuss et al. ..... 292/201
6,595,563 B2 * 7/2003 Kiernan ..... 292/341.16
6,634,685 B2 * 10/2003 Herron et al. ..... 292/341.16
6,857,671 B2 * 2/2005 Fly ..... 292/251.5
7,722,097 B2 * 5/2010 Schnarr et al. ..... 292/341.16
8,132,833 B2 * 3/2012 Schnekenburger ..... 292/341.16
2003/0127870 A1 * 7/2003 Schildwachter et al. 292/341.16
2004/0061343 A1 * 4/2004 Bashford ..... 292/341.16
2012/0193927 A1 * 8/2012 Gresser ..... 292/201

FOREIGN PATENT DOCUMENTS

EP 0792985 A1 9/1997

* cited by examiner

*Primary Examiner* — Mark Williams
(74) *Attorney, Agent, or Firm* — Lerner, David, Littenberg, Krumholz & Mentlik, LLP

(57) ABSTRACT

A door opener for closed and open circuit current operation has a door opener latch, switchover means mounted to move in a first rotary bearing for blocking and releasing the latch, armature adjustable about a second rotary bearing for blocking or releasing the switchover means, electromagnet for adjusting the armature, and restoring spring moving the armature to an inoperative position when the electromagnet is in the unenergized state. The switchover means has a blocking cross section facing the armature, and an adjacent release cross section recessed behind the blocking cross section. The armature has a plate-like design and a blocking recess in the central section merging with a slot-like release recess in the end section averted from the second bearing, the blocking cross section corresponding to the blocking recess and the release cross section corresponding to the release recess. The vertical distance between the first and second bearings is variable.

10 Claims, 8 Drawing Sheets

DOOR OPENER FOR CLOSED-CIRCUIT CURRENT OPERATION AND OPEN-CIRCUIT CURRENT OPERATION

CROSS-REFERENCE TO RELATED APPLICATIONS

The present application claims priority from DE 102011009782.1 filed Jan. 28, 2011, the disclosure of which is hereby incorporated herein by reference.

BACKGROUND

The invention relates to an electrical door opener which can be set up both for closed-circuit current operation and for open-circuit current operation.

Door openers of this kind have the advantage that they can be changed over from closed-circuit current operation to open-circuit current operation and vice versa as required. This already has advantages in respect of production and storage. A further advantage is that the changeover can also be carried out during service, for example in order to allow a door to be opened for safety reasons in the event of a power outage.

EP 0 792 985 B1 describes a door opener of this kind in which setting of the mode of operation the mode of operation can be changed by pivoting the armature, with the armature being operated by an electromagnet and this releasing or blocking a switchover means which interacts with a door opener latch. During closed-circuit current operation, the switchover means is blocked when the electromagnet is in the energized state and released when the electromagnet is in the unenergized state. During open-circuit current operation, the switchover means is blocked when the electromagnet is in the unenergized state and released when the electromagnet is in the energized state.

The object of the present invention is to specify a door opener of said kind which can be adjusted in another way.

SUMMARY

According to the invention, this object is achieved by the subject matter of Claim 1. Said claim proposes a door opener which can be set up both for closed-circuit current operation and for open-circuit current operation, having a door opener latch, a switchover means which is mounted such that it can move in a rotary bearing for the purpose of blocking and releasing the door opener latch, an armature which can be adjusted about a rotary bearing for the purpose of blocking or releasing the switchover means, an electromagnet for adjusting the armature, and a restoring spring which moves the armature to an inoperative position when the electromagnet is in the unenergized state, with the switchover means having a blocking cross section on its head section which faces the armature, and having an adjacent release cross section which is recessed behind the blocking cross section, with the armature preferably being of plate-like design and having a blocking recess in the central section, said blocking recess merging with a preferably slot-like release recess in the end section which is averted from the rotary bearing, and with the blocking cross section of the switchover means corresponding to the blocking recess of the armature and the release cross section of the switchover means corresponding to the release recess of the armature, with provision being made for it to be possible for the distance between the rotary bearing of the switchover means and the rotary bearing of the armature to be varied. This change in distance is formed such that, in the event of the switchover means and the armature being arranged at a right angle to one another, the displacement of the rotary bearing of the switchover means is parallel to the longitudinal axis of the switchover means and/or the displacement of the rotary bearing of the armature is transverse to the longitudinal axis of the armature. Parallel to the longitudinal axis means along the longitudinal axis or with a parallel offset with respect to said longitudinal axis.

The switchover between the two modes of operation is particularly simple in the case of the door opener according to the invention because a linear movement of a rotary bearing is possible by virtue of simple displacement in an elongate hole, and therefore it is possible both to produce the door opener and to change over the door opener in a particularly simple manner. It is possible to fix the displaced component or the displaced assembly, for example, using simple fastening screws which are required for assembly in any case.

Provision may be made for the rotary bearing of the switchover means to be arranged on or at a displacement element which can be displaced parallel to the longitudinal axis of the switchover means between a first position for open-circuit current operation and a second position for closed-circuit current operation, with, when the electromagnet is in the unenergized state, the blocking cross section of the switchover means passing through the blocking recess of the armature in the first position and the release cross section of the switchover means passing through the release recess of the armature in the second position, and with, when the electromagnet is in the energized state, the armature releasing the blocking cross section of the switchover means, and therefore releasing the switchover means, in the first position, and the blocking cross section of the switchover means passing through the blocking recess of the armature, and therefore blocking the switchover means, in the second position. Parallel to the longitudinal axis of the switchover means along the longitudinal axis or with a parallel offset to the longitudinal axis of the switchover means.

As an alternative, provision may be made for the rotary bearing of the armature to be arranged on or at a displacement element which can be displaced transverse to the longitudinal axis of the armature between a first position for open-circuit current operation and a second position for closed-circuit current operation, with, when the electromagnet is in the unenergized state, the blocking cross section of the switchover means passing through the blocking recess of the armature in the first position and the release cross section of the switchover means passing through the release recess of the armature in the second position, and with, when the electromagnet is in the energized state, the armature releasing the blocking cross section of the switchover means, and therefore releasing the switchover means, in the first position, and the blocking cross section of the switchover means passing through the blocking recess of the armature, and therefore blocking the switchover means, in the second position.

In an advantageous development, provision may be made for the rotary bearing of the armature and the electromagnet to be designed as a longitudinally displaceable assembly. The abovementioned displacement directions are always to be understood to relate, ideally, to the blocking position of the switchover means or to the inoperative position of the armature.

Provision may further be made for the switchover means to have at least one widened cross section and at least one narrowed cross section, with the blocking cross section of the switchover means being designed as the widened cross section and the release cross section of the switchover means being designed as the narrowed cross section.

The switchover means can have a longitudinal axis which is designed as a symmetrical axis of the widened cross section and of the narrowed cross section.

Provision may be made for the armature to have at least two differently sized recesses, with the larger recess being designed as the blocking recess of the armature and the smaller recess being designed as the release recess of the armature. The recesses are arranged such that they merge with one another, that is to say there is no material arranged between them.

Provision may therefore be made for the larger recess of the armature and/or the smaller recess of the armature to be designed as a recess which is open on one side or as a hole. The cross section of the larger recess can, in principle, be of any desired design, but can preferably be a square, rectangular or circular cross section. The cross section of the smaller recess can preferably be designed as a transverse rectangular slot.

The blocking recess of the armature can have a cross section which is larger than or the same size as the cross section of the blocking cross section of the switchover means and can have a blocking stop for the blocking cross section of the switchover means.

Provision may be made for the release recess of the armature to have a cross section which is larger than the cross section of the release cross section of the switchover means in order to allow a release movement of the release cross section of the switchover means.

The switchover means can be designed as a one-armed lever.

BRIEF DESCRIPTION OF THE DRAWINGS

The invention will now be explained in greater detail with reference to exemplary embodiments.

In the Drawings.

DETAILED DESCRIPTION

Figure 1C:
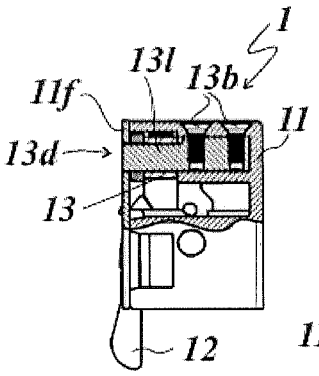
FIG. 1*c* shows a sectional view of the door opener along section line Ic-Ic in FIG. 2.
Figure 1A:
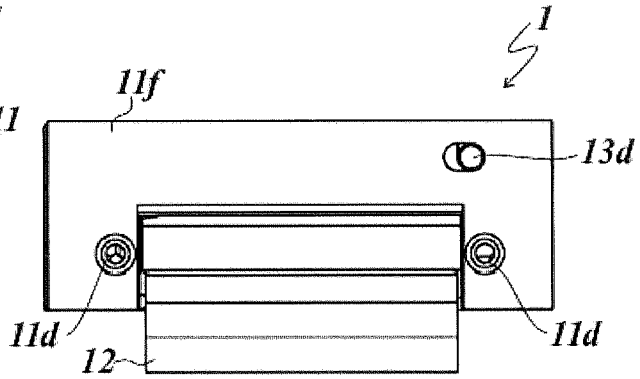
FIG. 1*a* shows a front view of an exemplary embodiment of a door opener according to the invention.
Figure 1B:
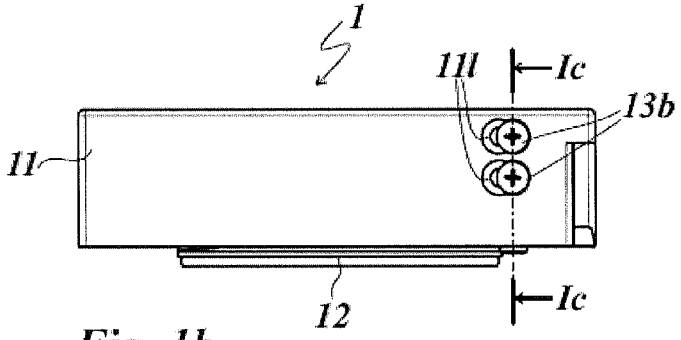
FIG. 1*b* shows a plan view of the door opener in FIG. 1.
Figure 2:
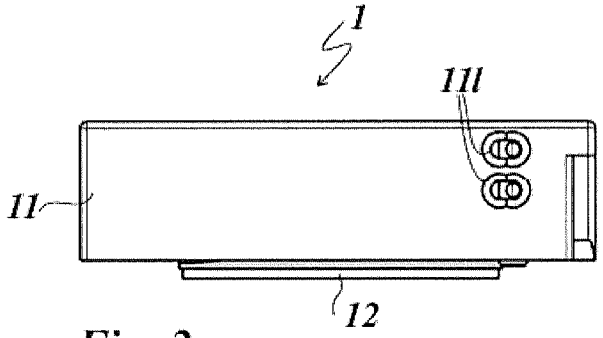
FIG. 2 shows the door opener in FIG. 1*c* without fastening screws for the switchover apparatus.
Figure 3A:
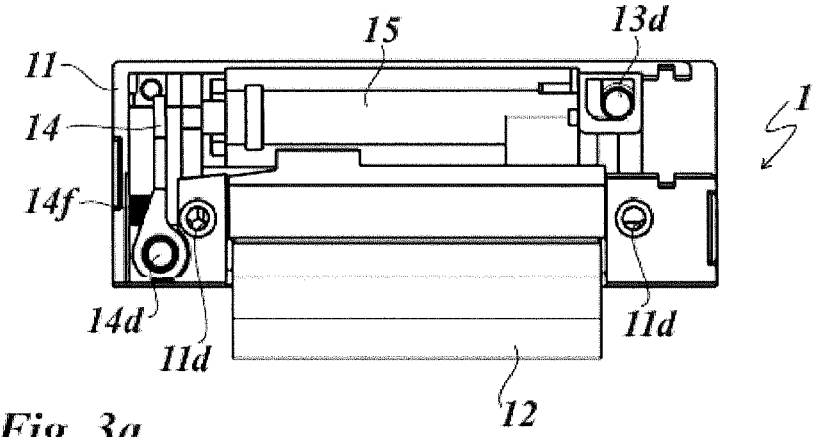
FIG. 3*a* shows the door opener in FIG. 1*a* without a front cover and without a switchover means.
Figure 3B:
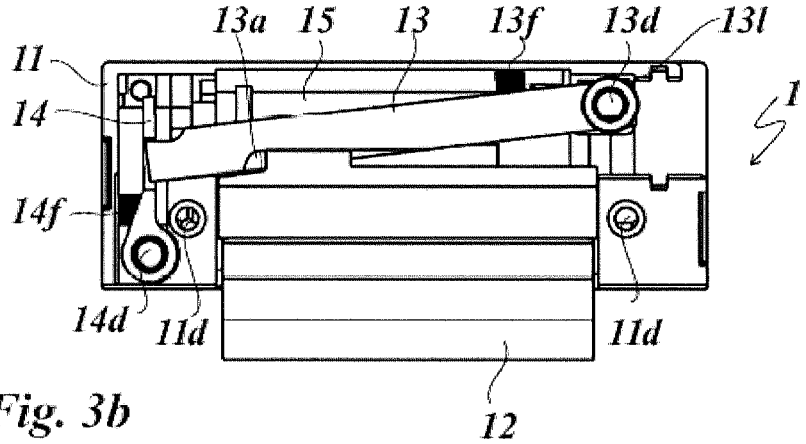
FIG. 3*b* shows the door opener in FIG. 3*a* with the switchover means in the "open-circuit current" switching position.
Figure 3C:
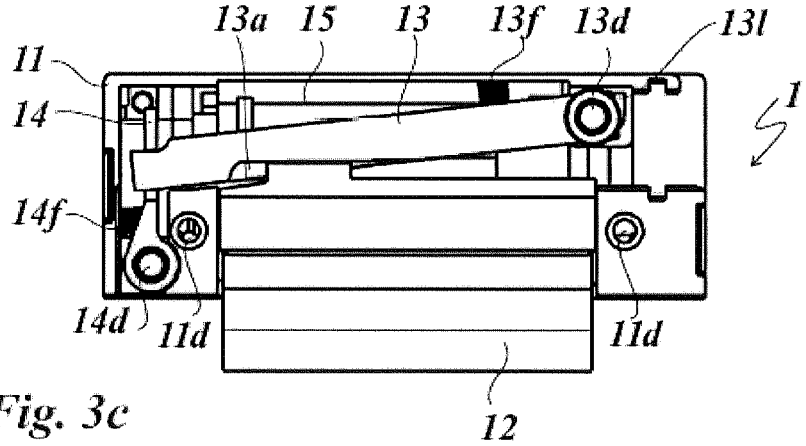
FIG. 3*c* shows the door opener in FIG. 3*a* with the switchover means in the "closed-circuit current" switching position.

FIGS. 1*a* to 1*c* show an electrically operated door opener 1 having a door opener latch 12 which interacts with a switchover means 13 (see FIGS. 3*b*, 3*c*). The switchover means 13 interacts with an armature 14 of an electromagnet 15. The armature 14 is designed as a one-armed lever with a rotary bearing 14*d* and is pushed into an inoperative position by a restoring spring 14*f*. The restoring spring 14*f* is designed as a helical compression spring which is supported against a door opener housing 11 in the illustrated case. The door opener housing 11 is closed at the front by a front cover 11*f*. For the purpose of fastening the door opener 1, passage holes 11*d* are provided in the door opener housing 11 in the illustrated case, said passage holes being intended to receive fastening screws (not illustrated).

The electromagnet 15 comprises a magnet coil and a soft-magnetic coil core which, in the energized state of the magnet coil, adjusts the armature 14 from its inoperative position to an operative position in which the armature 14 is pivoted in the direction of the inner wall of the door opener housing 11 and the restoring spring 14*f* is compressed.

In the illustrated case, the switchover means 13 is designed as a one-armed lever, of which the rotary bearing 13*d* is arranged on a longitudinally displaceable bearing block 131 (see FIG. 1*c*). The bearing block 131 has two threaded holes which are intended to receive fastening screws 13*b*. In the exemplary embodiment which is illustrated in FIG. 1, the fastening screws 13*b* are designed as cylindrical countersunk screws which pass through passage holes 111 which are arranged in the door opener housing 11 (FIGS. 1*b* and 1*c*). The passage holes 111 are in the form of elongate holes, and therefore the switchover means 13 is arranged in a longitudinally displaceable manner in the door opener housing 11. The switchover means 13 can therefore be fixed in two positions A and B in the door opener housing 11 (see FIG. 3*b* [Pos. A] and FIG. 3*c* [Pos. B] and FIGS. 4 to 7).

Figure 4A:
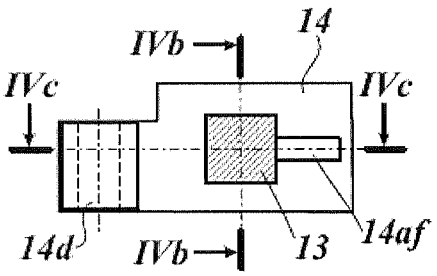
FIG. 4*a* shows a schematic illustration of part of the door opener in FIG. 3*b* in the unenergized state.
Figure 4B:
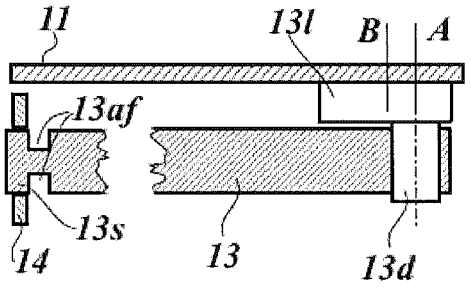
FIG. 4*b* shows a schematic sectional illustration of the door opener in FIG. 4*a* along section line IVb-IVb.

The switchover means 13 has, at its head section which faces the armature 14, a blocking cross section 13*s* and, adjoining the blocking cross section 13*s*, two mutually opposite release recesses 13*af* which form a release cross section which is recessed behind the blocking cross section 13*s* (FIG. 4*b*).

The armature 14 is of plate-like design and has, in the central section, a blocking recess 14*as* which merges with a slot-like release recess 14*af* in the end section which is averted from the rotary bearing 14*d* (FIG. 4*a*). The blocking recess 14*as* is congruent to the blocking cross section 13*s*, that is to say the switchover means 13 is blocked when the blocking cross section 13*s* of the switchover means 13 passes through the blocking recess 14*as* of the armature 14.

The base separation of the two release recesses 13*af* made in the switchover means 13 and the width thereof are selected such that the release cross section of the switchover means 13 can slide with play in the slot-like release recess 14*af* of the armature 14, specifically along the slot, that is to say along the longitudinal axis of the armature 14.

Figure 4C:
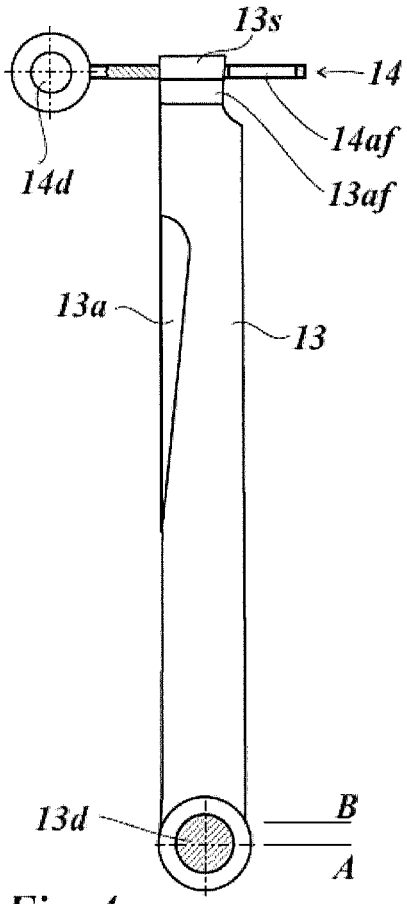
FIG. 4*c* shows a schematic sectional illustration of the door opener in FIG. 4*a* along section line IVc-IVc.
Figure 5A:
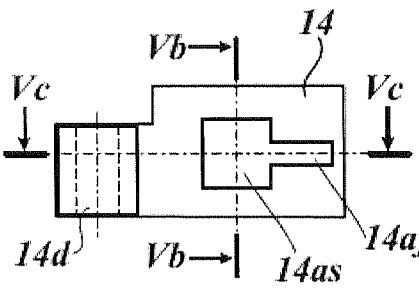
FIG. 5*a* shows a schematic illustration of part of the door opener in FIG. 3*b* in the energized state.
Figure 5B:
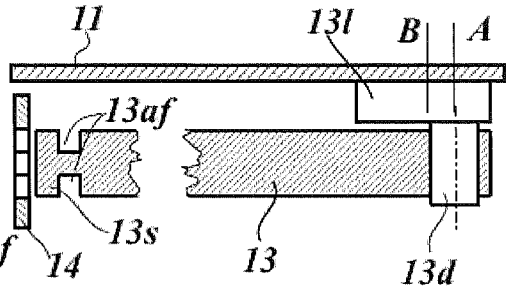
FIG. 5*b* shows a schematic sectional illustration of the door opener in FIG. 5*a* along section line Vb-Vb.

FIG. 3*b* and FIGS. 4 and 5 shows the door opener 1 during open-circuit current operation in which the rotary bearing 13*d* of the switchover means 13 is arranged in position A. During open-circuit current operation, the door opener latch 12 is blocked by the switchover means 13 when the electromagnet 15 is in the unenergized state.

FIG. 4 shows the door opener 1 during open-circuit current operation with an unenergized electromagnet 15. The blocking cross section 13*s* of the switchover means 13 passes through the blocking recess 14*as* of the armature 14, and therefore the switchover means 13 is blocked and, as a result, the door opener latch 12 is likewise blocked.

Figure 5C:
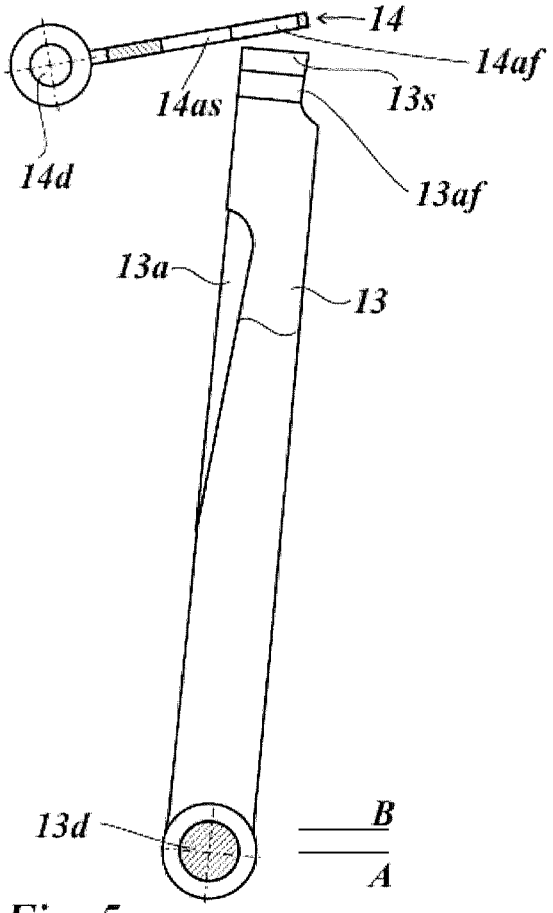
FIG. 5*c* shows a schematic sectional illustration of the door opener in FIG. 5*a* along section line Vc-Vc.

FIG. 5 shows the door opener 1 during open-circuit current operation with an energized electromagnet 15. The armature 14 is now pivoted in the direction of the inner wall of the door opener housing 11 (not illustrated) and releases the blocking cross section 13*s* of the switchover means 13, and therefore the switchover means 13 is pivoted about its rotary bearing 13*d* when the door opener latch (not illustrated) is pivoted. The door opener latch 12 engages in a recess 13*a* on the switchover means 13 (see FIG. 5*c* and FIG. 3*b*).

Figure 6A:
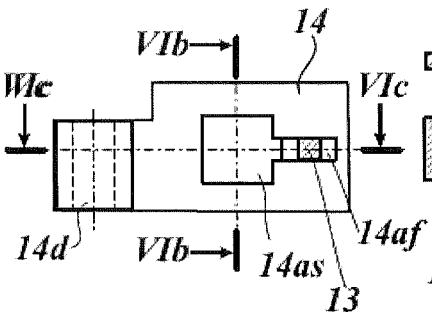
FIG. 6*a* shows a schematic illustration of part of the door opener in FIG. 3*c* in the unenergized state.
Figure 6B:
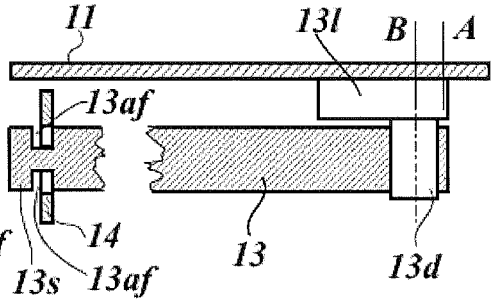
FIG. 6*b* shows a schematic sectional illustration of the door opener in FIG. 6*a* along section line VIb-VIb.
Figure 6C:
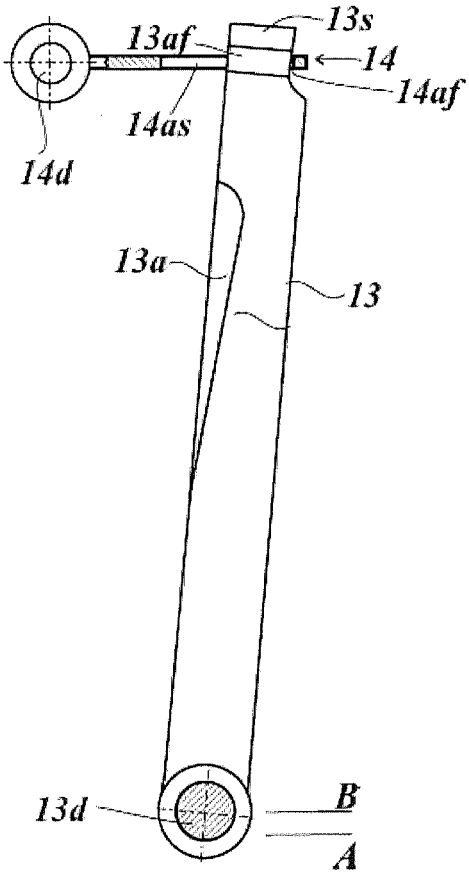
FIG. 6*c* shows a schematic sectional illustration of the door opener in FIG. 6*a* along section line VIc-VIc.
Figure 7A:
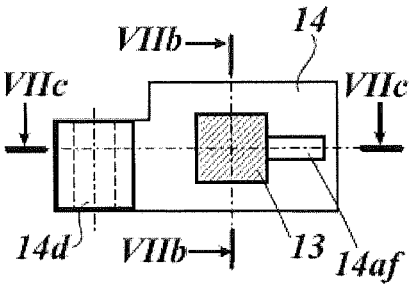
FIG. 7*a* shows a schematic illustration of part of the door opener in FIG. 3*c* in the energized state.
Figure 7B:
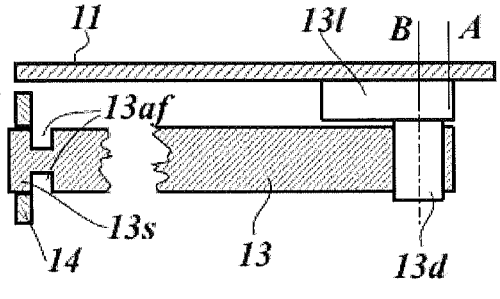
FIG. 7*b* shows a schematic sectional illustration of the door opener in FIG. 7*a* along section line VIIb-VIIb.

FIG. 3*c* and FIGS. 6 and 7 shows the door opener 1 during closed-circuit current operation during which the rotary bearing 13*d* of the switchover means 13 is arranged in position B.

FIG. 6 shows the door opener 1 during closed-circuit current operation with an unenergized electromagnet 15. In position B, the switchover means 13 is arranged so as to be displaced in the direction of the armature 14 to such an extent that said switchover means engages in the release recess 14*af* of the armature 14 by way of its release cross section and therefore can be pivoted by the door opener latch 12.

FIG. 7 shows the door opener 1 during closed-circuit current operation with an energized electromagnet 15. The armature 14 is now pivoted in the direction of the inner wall of the door opener housing (not illustrated), and therefore the blocking recess 14*as* of the armature 14, which is pivoted in the direction of the inner wall of the door opener housing (not illustrated), slides over the blocking cross section 13*s* of the switchover means 13 and thereby blocks the switchover means 13.

FIGS. 8 and 9 show a second exemplary embodiment which differs from the first exemplary embodiment in that the rotation axis of the switchover means 13 is now stationary and the rotation axis of the armature is longitudinally displaceable parallel with respect to the longitudinal axis of the switchover means 13. An assembly comprising the armature and the electromagnet is preferably designed to be longitudinally displaceable from a position A to a position B.

Figure 8A:
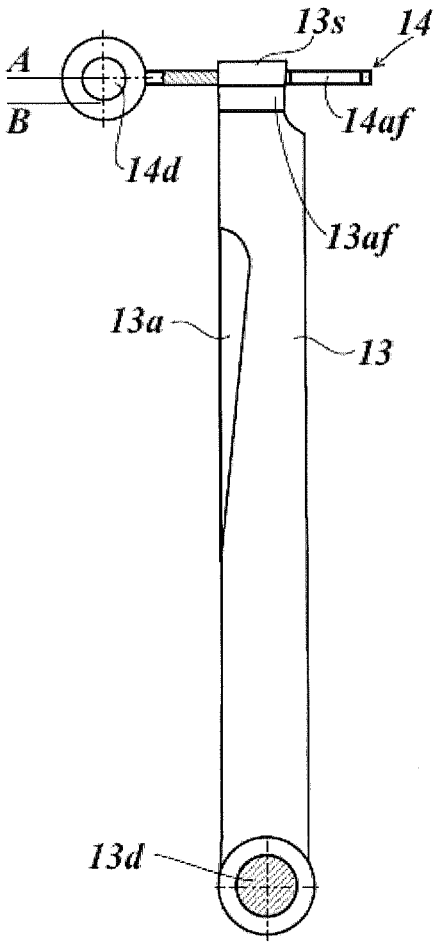
FIG. 8*a* shows a second embodiment of a door opener according to the invention in an analogous manner to the illustration in FIG. 4*c;*

FIG. 8*a* shows the door opener in an analogous manner to FIG. 4*c* during open-circuit current operation with an unenergized electromagnet. The switchover means 13 is blocked.

Figure 8B:
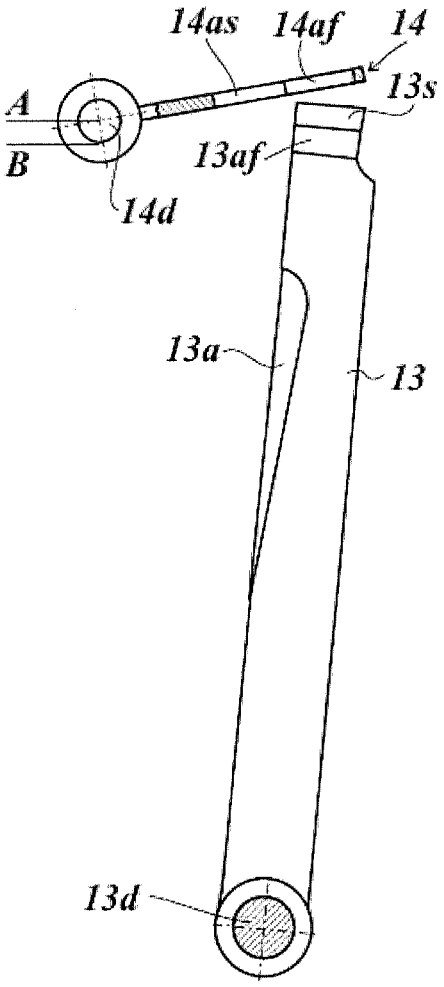
FIG. 8*b* shows the door opener in FIG. 8*a* in an analogous manner to the illustration in FIG. 5*c;*

FIG. 8*b* shows the door opener in an analogous manner to FIG. 5*c* during open-circuit current operation with an energized electromagnet. The switchover means 13 is released.

Figure 9A:
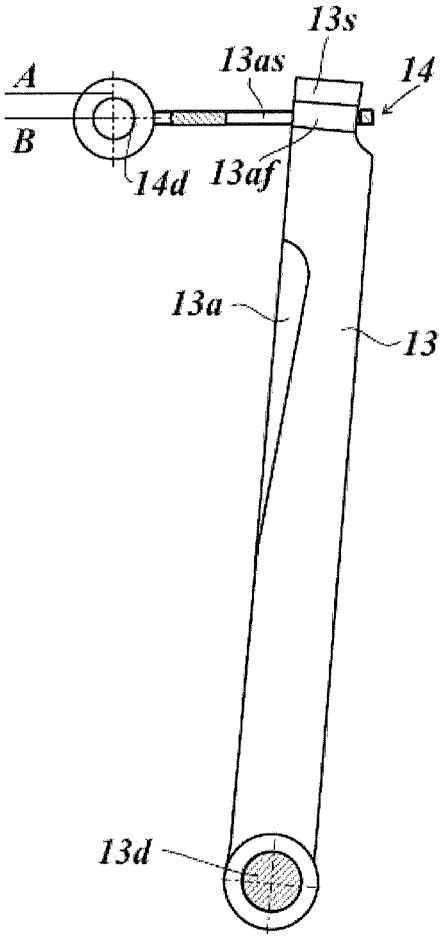
FIG. 9*a* shows the door opener in FIG. 8*a* in an analogous manner to the illustration in FIG. 6*c;*

FIG. 9*a* shows the door opener in an analogous manner to FIG. 6*c* during closed-circuit current operation with an unenergized electromagnet. The switchover means 13 is released.

Figure 7C:
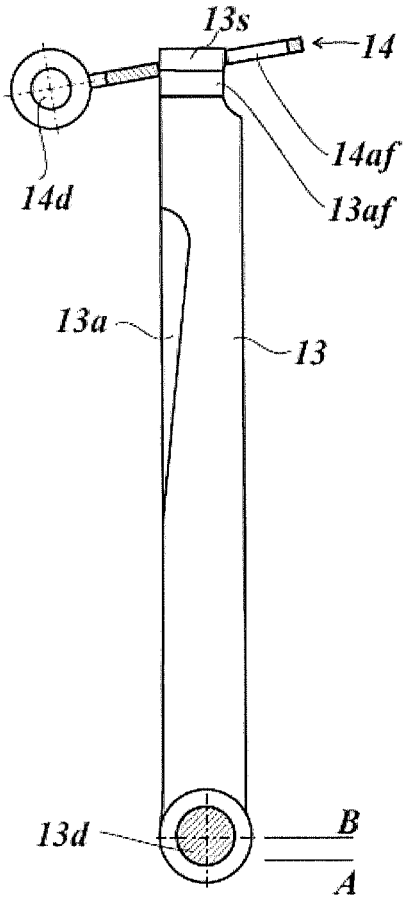
FIG. 7*c* shows a schematic sectional illustration of the door opener in FIG. 7*a* along section line VIIc-VIIc.
Figure 9B:
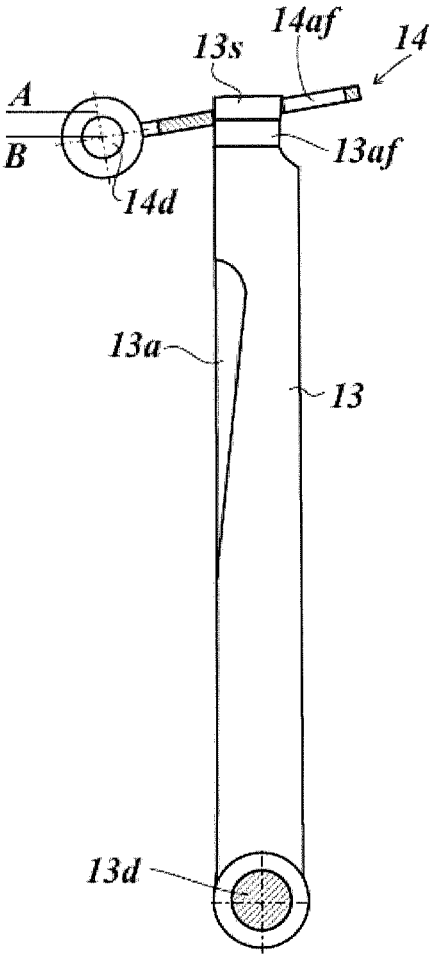
FIG. 9*b* shows the door opener in FIG. 8*a* in an analogous manner to the illustration in FIG. 7*c*.

FIG. 9*b* shows the door opener in an analogous manner to FIG. 7*c* during closed-circuit current operation with an energized electromagnet. The switchover means 13 is blocked.

The invention claimed is:

1. Door opener which can be set up both for closed-circuit current operation and for open-circuit current operation, the door opener having a door opener latch, a switchover means which is mounted such that it can move in a rotary bearing for the purpose of blocking and releasing the door opener latch, an armature which can be adjusted about a rotary bearing for the purpose of blocking or releasing the switchover means, an electromagnet for adjusting the armature, and a restoring spring which moves the armature to an inoperative position when the electromagnet is in the unenergized state, with the switchover means having a head section which faces the armature and a blocking cross section on the head section, and the switchover means having an adjacent release cross section which is recessed behind the blocking cross section and which faces the rotary bearing of the switchover means, with the armature having a central section and a blocking recess in the central section, said blocking recess merging with a release recess in the end section which is averted from the rotary bearing, and with the blocking cross section of the switchover means corresponding to the blocking recess of the armature and the release cross section of the switchover means corresponding to the release recess of the armature, the door opener being characterized in that a distance between the rotary bearing of the switchover means and the rotary bearing of the armature can be varied, wherein the rotary bearing of the switchover means is arranged on or at a displacement element which can be displaced parallel to the longitudinal axis of the switchover means between a first position (A) for open-circuit current operation and a second position (B) for closed-circuit current operation, or wherein the rotary bearing of the armature is arranged on or at a displacement element which can be displaced transverse to the longitudinal axis of the armature between another first position (A) for open-circuit current operation and another second position (B) for closed-circuit current operation.

2. The door opener according to claim 1, wherein, when the electromagnet is in the unenergized state, the blocking cross section of the switchover means passing through the blocking recess of the armature in the first position (A) and the release cross section of the switchover means passing through the release recess of the armature in the second position (B), and with, when the electromagnet (15) is in the energized state, the armature releasing the blocking cross section of the switchover means, and therefore releasing the switchover means, in the first position (A), and the blocking cross section of the switchover means passing through the blocking recess of the armature, and therefore blocking the switchover means, in the second position (B).

3. The door opener according to claim 1, wherein in the rotary bearing of the armature and the electromagnet are designed as a longitudinally displaceable assembly.

4. The door opener according to claim 1, wherein the switchover means has at least one widened cross section and at least one narrowed cross section, with the blocking cross section of the switchover means being designed as the widened cross section and the release cross section of the switchover means being designed as the narrowed cross section.

5. The door opener according to claim 3, wherein the switchover means has a longitudinal axis which is designed as a symmetrical axis of the widened cross section and of the narrowed cross section.

6. The door opener according to claim 1, wherein the armature has at least two differently sized recesses, with the larger recess being designed as the blocking recess of the armature and the smaller recess being designed as the release recess of the armature.

7. The door opener according to claim 5, wherein at least one of the larger recess of the armature or the smaller recess of the armature is designed as a recess which is open on one side or as a hole.

8. The door opener according to claim 1, wherein the blocking recess of the armature has a cross section which is larger than or the same size as the cross section of the blocking cross section of the switchover means and has a blocking stop for the blocking cross section of the switchover means.

9. The door opener according to claim 1, wherein the release recess of the armature has a cross section which is larger than the cross section of the release cross section of the switchover means in order to allow a release movement of the release cross section of the switchover means.

10. The door opener according to claim 1, wherein the switchover means is designed as a one-armed lever.

* * * * *